US005934109A

United States Patent [19]

Kiefer et al.

[11] Patent Number: 5,934,109

[45] Date of Patent: Aug. 10, 1999

[54] DISPENSER FOR FRONT LOADING WASHING MACHINE

[75] Inventors: Lynn E. Kiefer, Kellogg; Nedra A. Herr; Scott A. Merkle, both of Newton; Gary B. Jackovin, Ankeny, all of Iowa; William K. Szaroletta, Watkinsville, Ga.; Scott J. Bowie, Stanford, Calif.

[73] Assignee: Maytag Corporation, Newton, Iowa

[21] Appl. No.: 09/085,952

[22] Filed: May 28, 1998

[51] Int. Cl.[6] ..... D06F 39/02

[52] U.S. Cl. ..... 68/17 R

[58] Field of Search ..... 68/17 R; 134/99.2

[56] References Cited

U.S. PATENT DOCUMENTS

| | | | |
|---|---|---|---|
| 3,035,431 | 5/1962 | Smith et al. | 68/207 |
| 3,100,978 | 8/1963 | Howlett | 68/140 |
| 3,727,434 | 4/1973 | Bochan | 68/17 R |
| 4,160,367 | 7/1979 | Vona, Jr. | 68/17 R |
| 4,265,100 | 5/1981 | Kretcman et al. | 68/12 R |
| 5,548,978 | 8/1996 | Bongini et al. | 68/17 R |

FOREIGN PATENT DOCUMENTS

| | | | |
|---|---|---|---|
| 2555772 | 6/1977 | Germany | 68/17 R |
| 209770 | 12/1966 | Sweden | 68/17 R |
| 2 128 640 | 5/1984 | United Kingdom . | |

*Primary Examiner*—Philip R. Coe

*Attorney, Agent, or Firm*—Zarley, McKee, Thomte, Voorhees & Sease

[57] ABSTRACT

An improved front loading washing machine is provided with additive dispensers located in the shroud. The dispensers are integral with the shroud so as to have large upwardly disposed mouths for receiving additives, such as fabric softener and bleach. The dispensers are covered by the door when the door is closed, and thereby hidden from view. The position of the dispensers adjacent the front and top of the washing machine provides for easy access for filling the dispensers with desired additives.

29 Claims, 8 Drawing Sheets

DISPENSER FOR FRONT LOADING WASHING MACHINE

BACKGROUND OF THE INVENTION

Front loading washing machines are often used where top surface access is limited. Stacked appliances, with a lower washer and an upper dryer are common for use when space is limited, such as in apartments. Stacked appliances have essentially no top surface on the washer. It is desirable in all types of washers to have one or more dispensers for supplying laundry additives, such as detergent, fabric softener and bleach.

In prior art front loading washing machines, the additive dispenser typically is located on the front cabinet wall, and includes a passage or drain hoses for directing the additive into the wash tub mounted inside the cabinet. In such a construction, the opening or mouth of the dispenser is generally vertically oriented, which leads to difficult loading of the additive into the dispenser. Also, a door must be provided to cover the mouth of the dispenser.

Accordingly, a primary objective of the present invention is the provision of an improved front loading washing machine having an additive dispenser conveniently located in the door opening of the machine.

Another objective of the present invention is the provision of a front loading washing machine having an additive dispenser with an upwardly disposed mouth for easy pouring of additive into the dispenser.

A further objective of the present invention is the provision of a front loading washing machine having an additive dispenser which is hidden from view when the door is closed.

Another objective of the present invention is the provision of a dispenser for a front loading washing machine having a simple construction and easy access.

Still another objective of the present invention is the provision of an improved dispenser for a washing machine having a primary and secondary straining grate to assure dispensing of the additive.

A further objective of the present invention is the provision of a dispenser for a washing machine including a user removable dispenser cup and grate.

These and other objectives will become apparent from the following description of the invention.

SUMMARY OF THE INVENTION

An improved dispenser is provided for a front loading washing machine. The washing machine includes a cabinet with a tub rotatably mounted therein. A front door is pivotally movable between open and closed positions with respect to an opening on the front of the cabinet which provides access to the tub. A shroud surrounds the access opening and extends between the front of the cabinet and the tub. The dispenser of the present invention is integral with the shroud. Preferably, the dispenser is located adjacent an upper edge of the shroud. A pair of dispensers may be provided on opposite sides of the shroud. The mouth of the dispenser is upwardly disposed. A dispenser drain leads from the bottom of the dispenser to the interior of the tub. A grate or filter may be provided in the dispenser to prevent over-size particles or foreign objects from entering the tub through the dispenser.

DETAILED DESCRIPTION OF THE INVENTION

Figure 1:
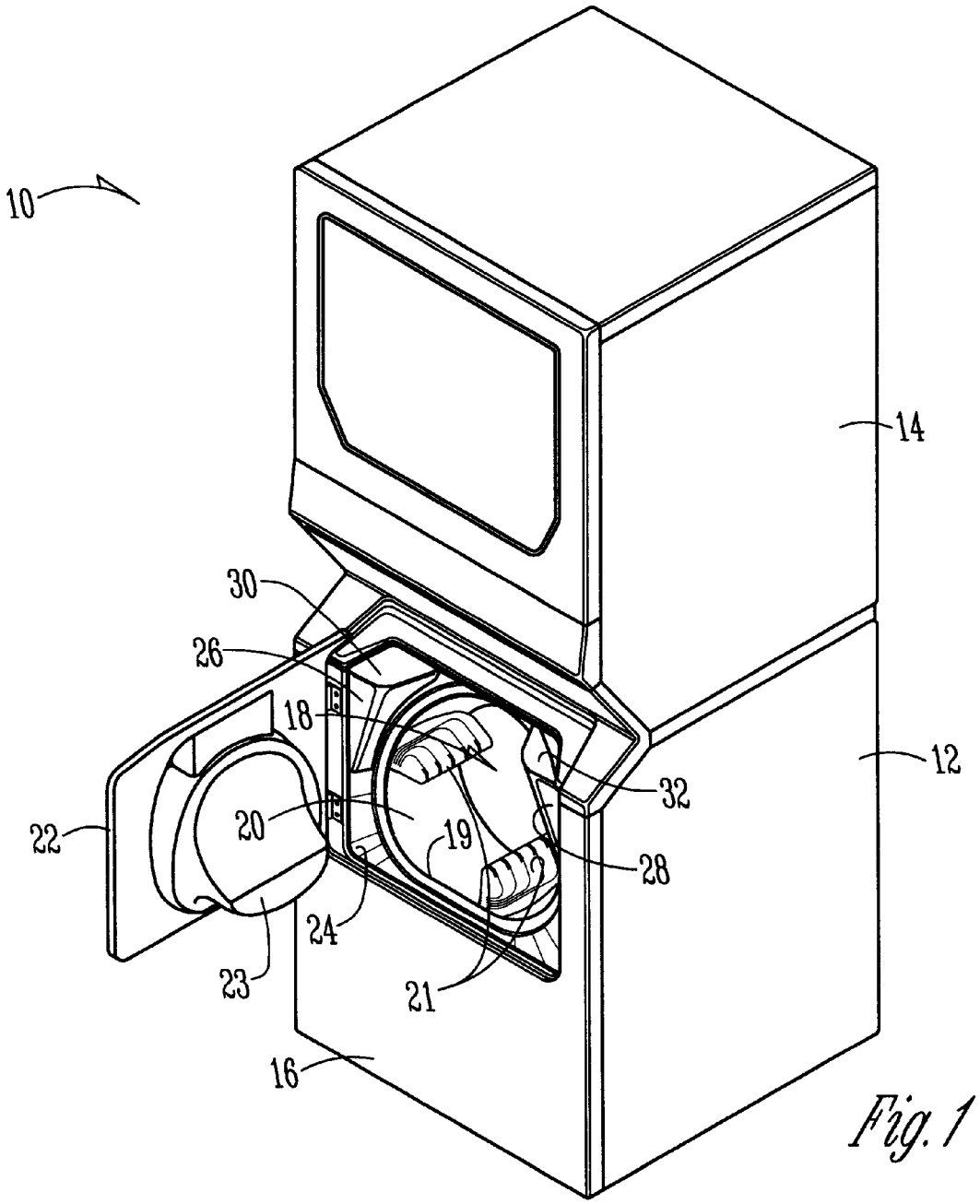
FIG. 1 is a perspective view of a stacked appliance assembly with a lower washing machine and an upper dryer.
Figure 2:
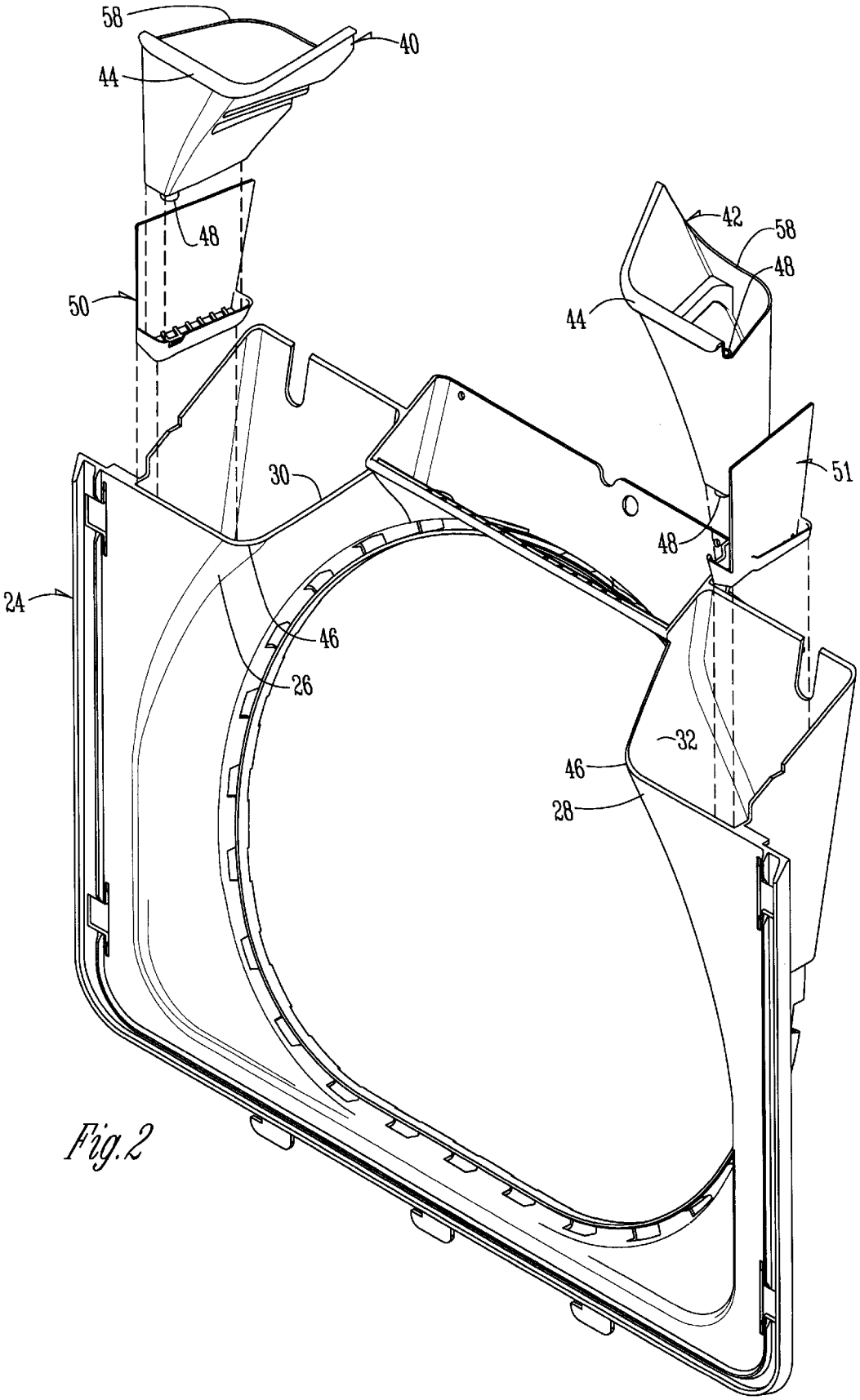
FIG. 2 is an exploded perspective view of the shroud and dispenser structure of the present invention.
Figure 3:
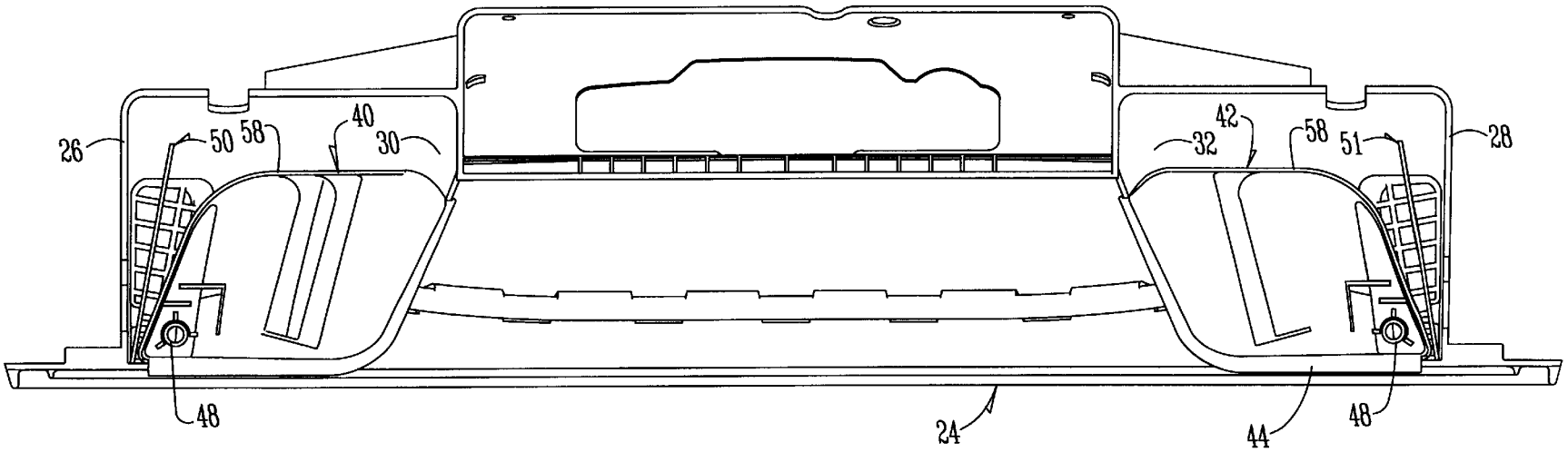
FIG. 3 is a top plan view of the assembled embodiment shown in FIG. 2.
Figure 5:
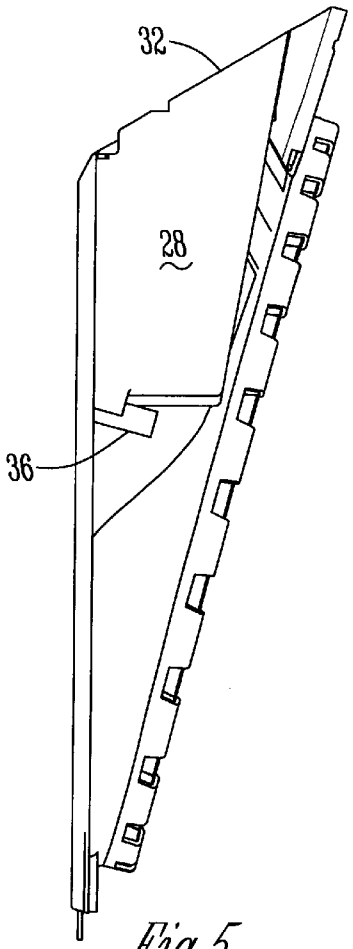
FIG. 5 is a side elevation view of the shroud.
Figure 4:
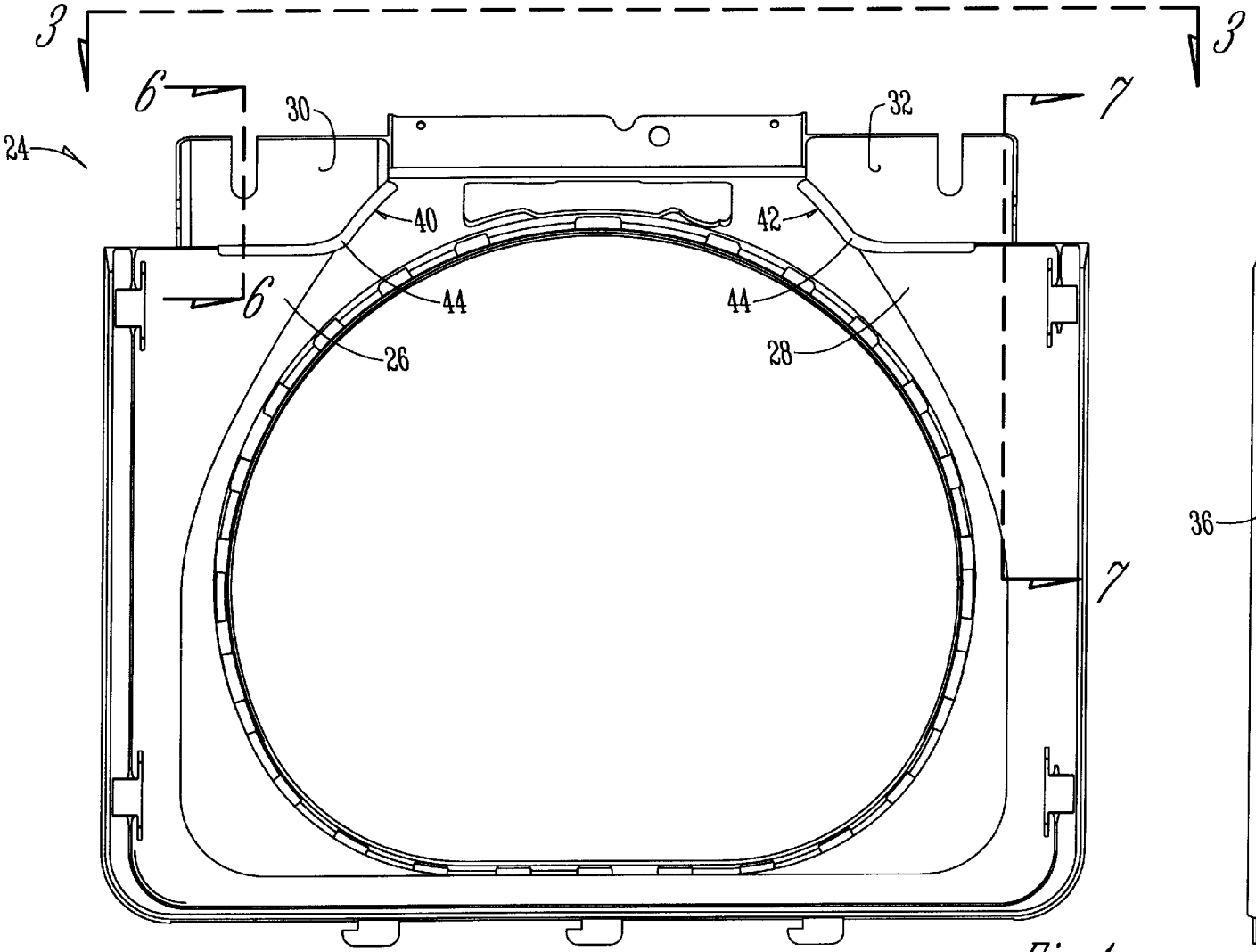
FIG. 4 is a front elevation view of the washing machine shroud.
Figure 6:
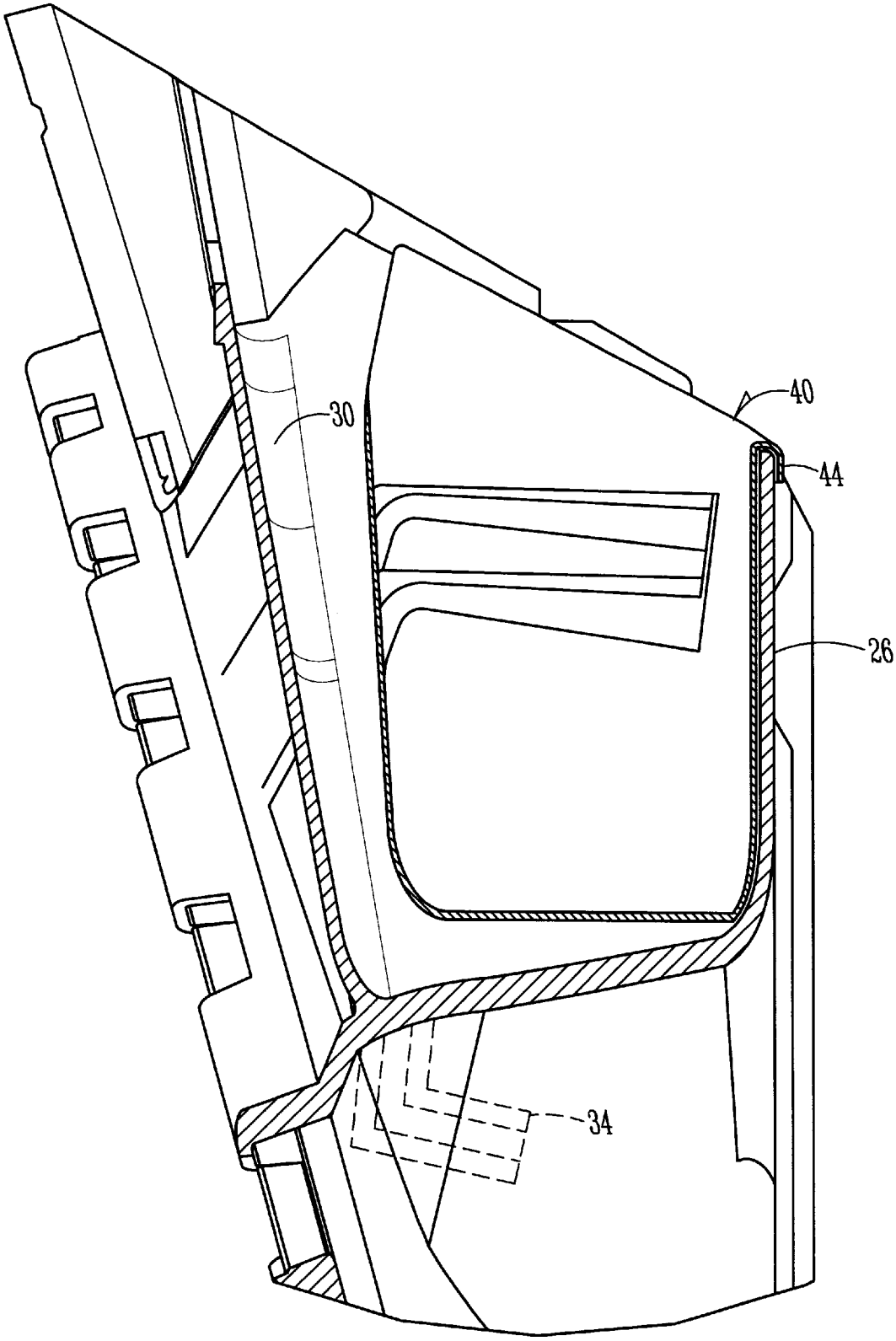
FIG. 6 is a sectional view taken along lines 6—6 of FIG. 4.
Figure 7:
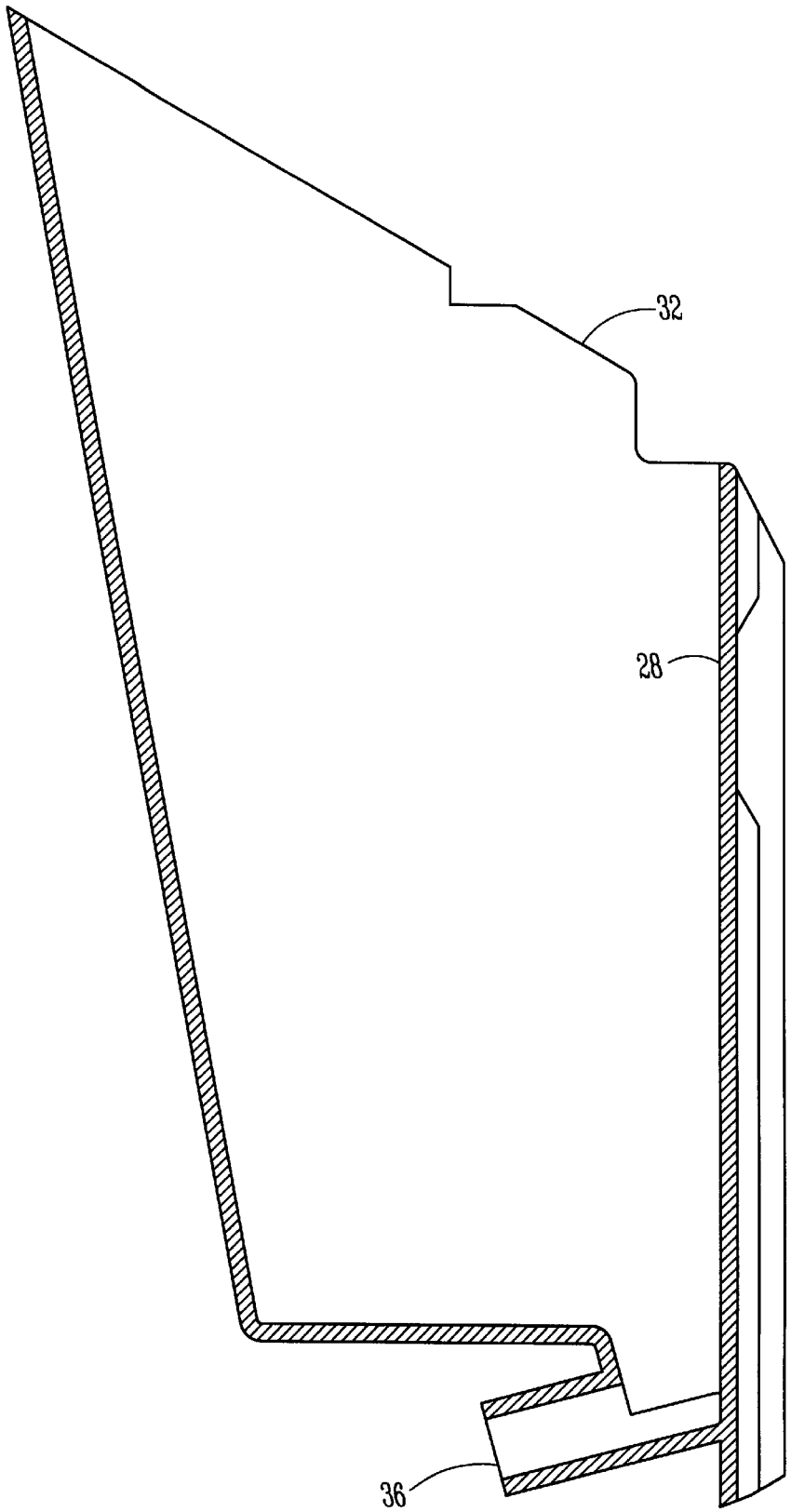
FIG. 7 is a sectional view taken on lines 7—7 of FIG. 4.

As shown in the drawings, the reference numeral 10 generally designates a stacked appliance assembly, with a lower washing machine 12 and an upper dryer 14. The washer 12 includes a cabinet with a front panel or face 16. An opening 18 in the front panel 16 provides access to a tub 20 which is rotatably mounted within the washer 12. Baffles 21 are provided on the inside wall of the tub. A door 22 is pivotally mounted to the front panel 16 of the washer 12 for movement between opened and closed positions with respect to the opening 18. A rubber boot seal 19 extends around the opening 18 for sealing engagement with the door plug 23. The above-described structure is conventional and does not constitute a part of the present invention.

The present invention is directed towards a shroud 24 which extends around the access opening 18 from the front panel 16 to the tub 20. The shroud includes a first additive dispenser 26, and a second additive dispenser 28. The dispensers 26, 28 are integrally formed or molded into the shroud 24 so as to be fixed with respect thereto. Each dispenser 26, 28 includes an upwardly and horizontally disposed mouth 30, 32 respectively. The dispensers 26, 28 are adjacent an upper edge of the shroud so as to provide easy visibility and easy filling when the door 22 is open. The first dispenser 26 has a lower opening or drain 34 such that additive contained within the dispenser 26 can be released into the tub 20. Similarly, the second dispenser 28 includes a lower drain or opening 36 to direct additive from the dispenser 28 into the tub 20.

In the preferred embodiment, each dispenser 26, 28 includes a cup 40, 42, respectively, which is removably fit within the dispenser. More particularly, the cups 40, 42 each include an upper lip 44 which extends over the upper front and side edge 46 of the respective dispenser 26, 28 to position the cup within the dispenser. Each cup 40, 42 includes an upstanding drain tube 48 which functions by conventional siphoning action to the respective drains 34, 36.

Figure 8:
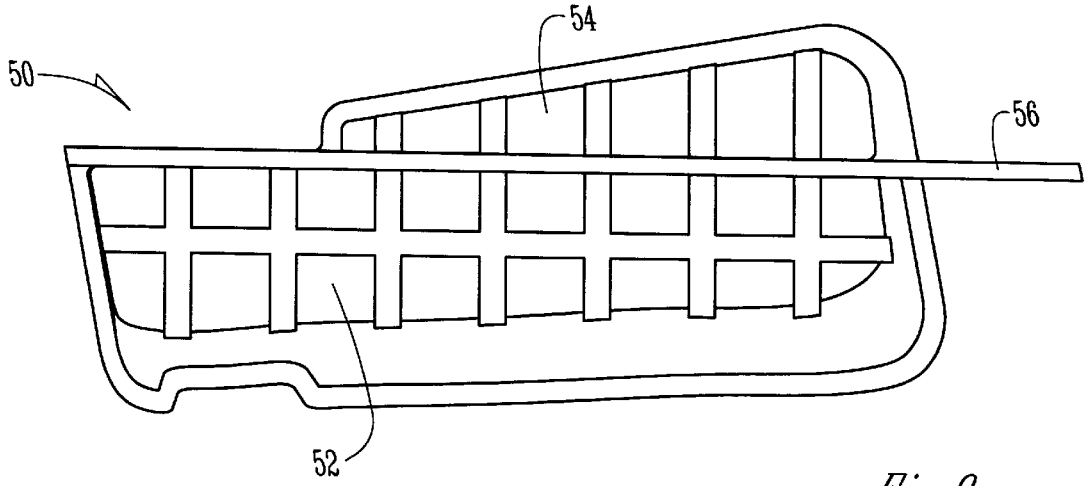
FIG. 8 is a top plan view of the removable grate.

In the preferred embodiment, each dispenser 26, 28 also includes a grate 50 positioned below the respective cup 40, 42. As best seen in FIG. 8, each grate 50 includes a primary section 52 and a secondary section 54, with a dividing wall 56 therebetween. The primary grate section 52 is positioned beneath the drain tube 48.

In use, the desired additive, such as detergent, bleach and fabric softener, is placed into the respective cups 40, 42 prior to the start of the wash cycle. During the operation of the washing machine 12, fresh water will be directed into the cups 40, 42 at designated times during the wash cycle. When the fresh water enters a cup 40, 42, the resulting water/additive mixture will overflow the lower edge 58 of the cup and drain out of the bottom of the respective dispenser 26, 28 via the respective drain 34, 36 into the tub 20. After the supply of fresh water into the dispenser cup 40, 42 stops, conventional siphon action will draw substantially all of the water/additive mixture from the respective cup.

If the primary section 52 of one of the grates 50 becomes clogged, the water/additive mixture level will rise and eventually spill over the top of the dividing wall 56 for passage through the secondary section 54 of the grate 50. Thus, draining is accomplished through the secondary grate section 54 of grate 50 so as to not overflow the dispenser 26, 28 and place liquid on the floor. At the end of the wash cycle, the user can visually check to determine any clogging of the grate 50 since, with the primary section 52 clogged, liquid will remain in dispenser 26, 28 at the end of the cycle. This is because the siphon path through primary section 52 was clogged. The cups 40, 42 and grates 50 can then be easily removed without the use of tools for cleaning. The design of the grate 50 thus accommodates clogging of primary section 52 without allowing liquid to overflow onto the floor.

Figure 9:
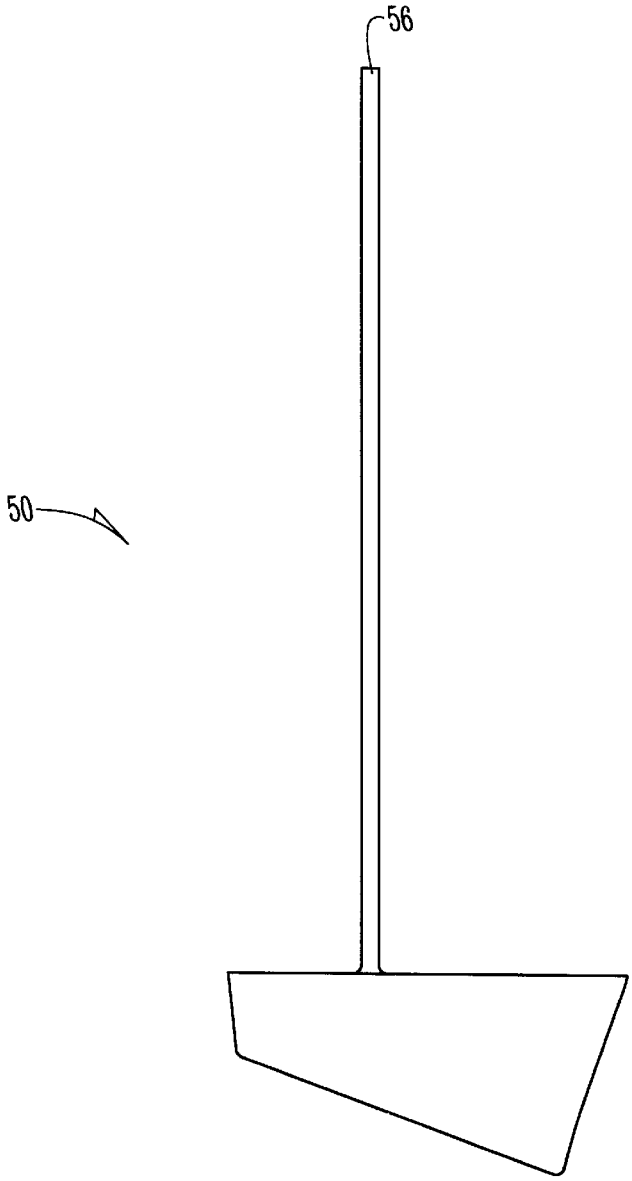
FIG. 9 is a side elevation view of the removable grate.
Figure 10:
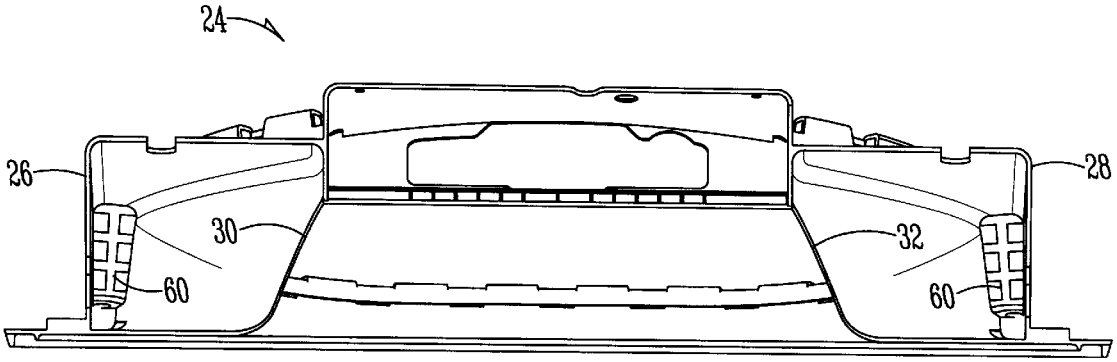
FIG. 10 is a top plan view of an alternative embodiment shroud and dispenser according to the invention.

In an alternative embodiment, as shown in FIG. 9, a single removable grate 60 may be provided in the bottom of the dispensers 26, 28 above the drains 34, 36.

In the preferred embodiment, the dispensers 26, 28 are protected and hidden from view when the door 22 is in the closed position. When the door 22 is opened, the horizontally disposed mouths 30, 32 of the dispensers 26, 28 provide easy loading of additive into the dispensers adjacent the top of the washing machine 12, without having to reach into or through the access opening 18. It is further envisioned that, in an alternate commercial embodiment of the instant invention, the upper right and left corners of the door 22 could be open so that the shroud mounted dispensers 26, 28 can be accessed without opening the door 22. A different additive, such as detergent, fabric softener and bleach, may be loaded into each dispenser 26, 28. The release of additives from. the dispensers 26, 28 is controlled in known and conventional manners. The integral construction of the dispensers 26, 28 with the shroud 24 provides for simplified construction with reduced costs. Also, the dispenser cups 40, 42 may have internal walls to define separate compartments for holding different additives, with each compartment having a drainage opening for release of the specific additive into the tub 20. As a further alternative, the dispenser cups 40, 42 can be pivotally mounted on the shroud 24 for movement to and from the dispensers 26, 28.

It is understood that the dispensers of the present invention can be utilized on stand alone front loading washing machines which are not in a stacked arrangement, as shown in the drawings. It is also understood that the shroud 24 may be constructed with a single dispenser, rather than a pair of dispensers as shown in the drawings and that shroud 24 may further include three or four dispensers for selectively dispensing additives such as detergent, fabric softener and bleach or a prewash material, detergent, fabric softener and bleach.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An improved front loading clothes washing machine having a cabinet with a front wall, an opening in the front wall of the cabinet, a rotatable tub mounted in the cabinet with an open forward end adjacent the cabinet opening, a shroud extending around the opening, and a door pivotally connected to the cabinet for movement between opened and closed positions relative to the opening, the improvement comprising:

an additive dispenser on the shroud, the dispenser being hidden from view when the door is in the closed position.

2. The washing machine of claim 1 wherein the dispenser is integral with the shroud.

3. The washing machine of claim 1 wherein the dispenser has a mouth for receiving the additive, the mouth being upwardly disposed.

4. The washing machine of claim 1 wherein the dispenser includes a drainage opening to direct additive into the tub.

5. The washing machine of claim 1 wherein the dispenser includes a removable grate for preventing oversized particles from entering the tub through the dispenser.

6. The washing machine of claim 1 wherein the dispenser includes a removable cup for holding the additive prior to dispensement into the tub.

7. The washing machine of claim 1 wherein the dispenser is molded into the shroud.

8. The washing machine of claim 1 wherein at least a second additive dispenser is provided on the shroud.

9. The washing machine of claim 8 wherein the dispensers are spaced apart from one another on opposite sides of the shroud.

10. The washing machine of claim 1 wherein the dispenser is located adjacent an upper edge of the shroud.

11. The washing machine of claim 1 wherein the dispenser is fixed in position on the shroud.

12. The washing machine of claim 1 wherein the dispenser includes a first grate for normally straining the additive before entry into the tub, and a second grate to strain the additive when the first grate becomes clogged.

13. The washing machine of claim 12 wherein the first and second grates are separated by an upstanding dividing wall with the second grate positioned to strain the additive if the first grate becomes clogged and dispensed additive overflows the dividing wall.

14. An improved front loading clothes washing machine having a cabinet with a top surface and a front wall, with an opening in the front wall, a rotatable tub mounted in the cabinet with an open forward end adjacent the cabinet opening, a shroud extending around the opening, and a door pivotally connected to the cabinet for movement between opened and closed positions relative to the opening, the improvement comprising;

an additive dispenser on the shroud and having an upwardly disposed mouth for introducing additive into the dispenser.

15. The washing machine of claim 14 wherein the dispenser is integral with the shroud.

16. The washing machine of claim 14 wherein the mouth of the dispenser is adjacent the top surface and front wall of the cabinet.

17. The washing machine of claim 14 wherein the dispenser includes a drainage opening to direct additive into the tub.

18. The washing machine of claim 14 wherein the dispenser includes a removable grate for preventing oversized particles from entering the tub through the dispenser.

19. The washing machine of claim 14 wherein the dispenser includes a removable cup for holding the additive prior to dispensement.

20. The washing machine of claim 14 wherein the dispenser is molded into the shroud.

21. The washing machine of claim 14 wherein at least a second additive dispenser is provided on the shroud.

22. The washing machine of claim 21 wherein the dispensers are spaced apart from one another on opposite sides of the shroud.

23. The washing machine of claim 22 wherein the dispenser is located adjacent an upper edge of the shroud.

24. The washing machine of claim 14 wherein the dispenser is fixed in position on the shroud.

25. The washing machine of claim 14 wherein the dispenser includes a first grate for normally straining the additive before entry into the tub, and a second grate to strain the additive when the first grate becomes clogged.

26. The washing machine of claim 25 wherein the first and second grates are separated by an upstanding dividing wall with the second grate positioned to strain the additive if the first grate becomes clogged and dispensed additive overflows the dividing wall.

27. An additive dispenser for a washing machine having a cabinet and a rotatable tub mounted in the cabinet, the dispenser comprising:

a cup for holding additive, the cup being in communication with the tub so that additive can be supplied from the cup to the tub; and a strainer having first and second grates with a dividing wall therebetween, the strainer being between the cup and the tub such that additive flows from the cup and through the strainer before entering the tub.

28. The additive dispenser of claim 27 wherein the additive normally passes through the first grate, and passes through the second grate when the first grate becomes clogged.

29. The additive dispenser of claim 27 wherein the cup and strainer are removably mounted in the washing machine.

* * * * *